US005927744A

United States Patent [19]

Knapschafer

[11] Patent Number: 5,927,744

[45] Date of Patent: Jul. 27, 1999

[54] SNOWBOOT BINDING FOR A SNOWBOARD AND THE LIKE

[76] Inventor: Myron L. Knapschafer, 4200 W. 23rd Ave., Denver, Colo. 80212

[21] Appl. No.: 08/948,859

[22] Filed: Oct. 10, 1997

Related U.S. Application Data

[63] Continuation-in-part of application No. 08/621,747, Mar. 22, 1996, abandoned.

[51] Int. Cl.[6] ..... A63C 9/24

[52] U.S. Cl. ..... 280/619; 280/14.2; 36/50.5

[58] Field of Search ..... 36/50.1, 50.5; 280/14.2, 619, 621, 622

[56] References Cited

U.S. PATENT DOCUMENTS

| | | | |
|---|---|---|---|
| 2,925,672 | 2/1960 | Trovato | 36/50.1 |
| 3,182,366 | 5/1965 | Teufel | 36/50.1 |
| 4,547,980 | 10/1985 | Olivieri | 36/50.5 |
| 4,727,627 | 3/1988 | Baggio et al. | 36/50.5 |
| 5,727,797 | 3/1998 | Bowles | 280/14.2 |
| 5,758,895 | 6/1998 | Bumgarner | 280/14.2 |
| 5,769,446 | 6/1998 | Borsoi | 280/14.2 |

FOREIGN PATENT DOCUMENTS

| | | | |
|---|---|---|---|
| 234-317 | 9/1987 | European Pat. Off. | 36/50.5 |
| 13270 | 11/1903 | Norway | 280/619 |

*Primary Examiner*—J J Swann
*Assistant Examiner*—Frank Vanaman
*Attorney, Agent, or Firm*—Edwin H. Crabtree; Ramon L. Pizarro; Donald W. Margolis

[57] ABSTRACT

A binding used for securing a snowboarder's snowboots on top of a snowboard. Two pair of the bindings are used for mounting on the snowboard and received around a portion of the instep and around a portion of the toe of each snowboot. Broadly, each binding includes a flexible strap having a first end attached to a ratchet assembly mounted on the snowboard and adjacent one side of the snowboot. A second end of the strap is attached to a quick release assembly mounted on the snowboard and adjacent an opposite side of the snowboot. The ratchet assembly is used for tightening the flexible strap on the snowboot. The ratchet assembly includes a spool with spool gear. The first end of the strap is attached to the spool. A spool release lever is attached to a side of the spool gear. A spool advancing lever is pivotly mounted to the spool release lever. One end of the spool advancing lever is received between gear teeth of the spool gear. The spool advancing lever is used for rotating the spool and tighten the strap thereon. A spool locking lever is pivotly mounted on the spool housing. One end of the spool locking lever is received between gear teeth of the spool gear and spring biased thereon. When the spool release lever is pivoted in one direction and the spool advancing lever and spool locking lever are pivoted in an opposite direction, the spool is released for unwrapping the strap on the spool.

17 Claims, 2 Drawing Sheets

SNOWBOOT BINDING FOR A SNOWBOARD AND THE LIKE

The subject application in a continuation-in-part application of an application filed by the inventor on Mar. 22, 1996 and having Ser. No. 08/621,747, abandoned.

BACKGROUND OF THE INVENTION (a) Field of the Invention

This invention relates to bindings used with ski equipment and more particularly but not by way of limitation, to a binding used for tightening and releasing a boot on a snowboard.

(b) Discussion of Prior Art

In the ski industry, there are generally two types of bindings. One is a high back or buckle binding and the other is a plate binding. The high back or buckle binding is designed for use with soft boots and is constructed of plastic. The conventional high back binding includes a base plate, a high back support and various types of straps. The basic design of the plate binding consists of a rigid base plate or a toe and heel plate having extensions for clamping a hard shell boot thereon.

While there are numerous types of prior art snowboard bindings, all of the bindings include a base plate or are plateless. A major disadvantage of the prior art snowboard bindings is the lack of control associated with the binding straps which lacked the leverage and/or durability to adequately tighten the straps on the snowboot.

Early strap systems for snowboard bindings included the use of VELCRO and while later bindings rely on the user adjusting the strap so that connecting buckles by the brand name of "FASTEX" were in close proximity when physically forcing them into a locked position. The type of binding was replaced by cam lever buckles with wire bales attached to one end of the strap. Slotted blocks were fitted on the end of the other strap into which the bales could be attached. These type of cam lever buckles allowed only about a half inch take up by mechanical leverage after the mating parts were physically forced close enough together to make a connection. This type of binding provided inadequate tension allowing the wire bales to slip out of the blocks when the snowboarder's soft boots were compressed as a result of jumping or maneuvering.

A current strap binding for soft boots and used on most mass produced snowboards employ a ratchet buckle and strap. The binding is described in U.S. Pat. No. 3,662,435to Ivor J. Allsop. This binding is an improvement over earlier bindings inasmuch as the serrated plastic strap does not slip out of a spring loaded metal clamp when the rider's boot is compressed during jumps and maneuvers. However, because the strap still has to be forced into the spring loaded metal clamp, it is cumbersome to use. Also, the thin serrated strap is made of plastic which becomes brittle with age and unlike fabric it ages rapidly or it become brittle in cold weather which ever comes first and cannot reliably withstand stock during jumps and maneuvers. A broken strap will prevent a snowboarder from maintaining control of the board.

A further disadvantage of prior art snowboard binding straps is the need to use both hands to buckle and unbuckle the straps. This is because all prior art devices require some physical force torque the strap or wire bale into a holding mechanism before a cam lever can be activated. In the release process, the cam lever has to be related and the spring loaded Clamp has to be depressed while the bale or strap is removed from the slotted block or clamp.

Therefore, because of the above mentioned disadvantages of current bindings for snowboards, there is a need for a binding which is durable, not adversely affected by cold weather and whose mating parts can be attached without the snowboarder having to use physical force. The subject invention solves the above mentioned problems with the following objects and advantages as described herein.

SUMMARY OF THE INVENTION

In view of the foregoing, it is a primary object of the subject invention is to provide a snowboarder with a binding that eliminates the need of physical force in latching a strap member to an opposite strap member or forcing the strap member into a spring loaded latch.

Another object of the invention is to provide a ratchet assembly and quick release assembly attached to a strap that can be readily adjusted manually in order to permit proper and easy fastening and unfastening of the binding to the snowboarder's snowboot.

Still another object of the invention is to provide a binding that is stronger, more durable and made with material that is not affected by cold weather.

A further object of the snowboard binding is it can be affixed to a variety of different types and designs of snowboards. The binding is economical to manufacture, efficient in operation and fool-proof in use.

The snowboard binding includes a flex e strap having a first end attached to a ratchet assembly mounted on a snowboard and adjacent one side of a snowboot. A second end of the strap is attached to a quick release assembly mounted on the snowboard and adjacent an opposite side of the snowboot. The ratchet assembly is used for tightening the flexible strap on the snowboot. The ratchet assembly includes a spool with spool gear. The first end of the strap is attached to the spool. The spool is rotatably mounted on a spool housing which is attached to a first vertical side of a "U" shaped plate rail. The plate rail is mounted on top of the snowboard. A spool release lever is attached to a side of the spool gear. A spool advancing lever is pivotly mounted to the spool release lever. One end of the spool advancing lever is received between gear teeth of the spool gear. The spool advancing lever is used for rotating the spool and tighten the strap thereon. A spool locking lever is pivotly mounted on the spool housing. One end of the spool locking lever is received between gear teeth of the spool gear and spring biased thereon. When the spool release lever is pivoted in one direction and the spool advancing lever and spool locking lever are pivoted in an opposite direction, the spool is released for unwrapping the strap on the spool. The quick release assembly includes a clip pin mounted on a second vertical side of the plate rail. The clip pin is used to receive a clip thereon. The clip is attached to the second end of the strap. A clip latch and release lever is pivotly mounted on the second vertical side of the plate rail. The clip latch and release lever includes a handle with a beveled indent not shown, and a beveled notch. The beveled indent in the handle fits over the bolt head that holds the contained clip and helps to the clip in place on the clip pin. The beveled notch is used release the clip from the clip pin when a snowboarder wishes to remove the snowboot from the binding.

These and other objects of the present invention will become apparent to those familiar with snowboard bindings and ski bindings from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
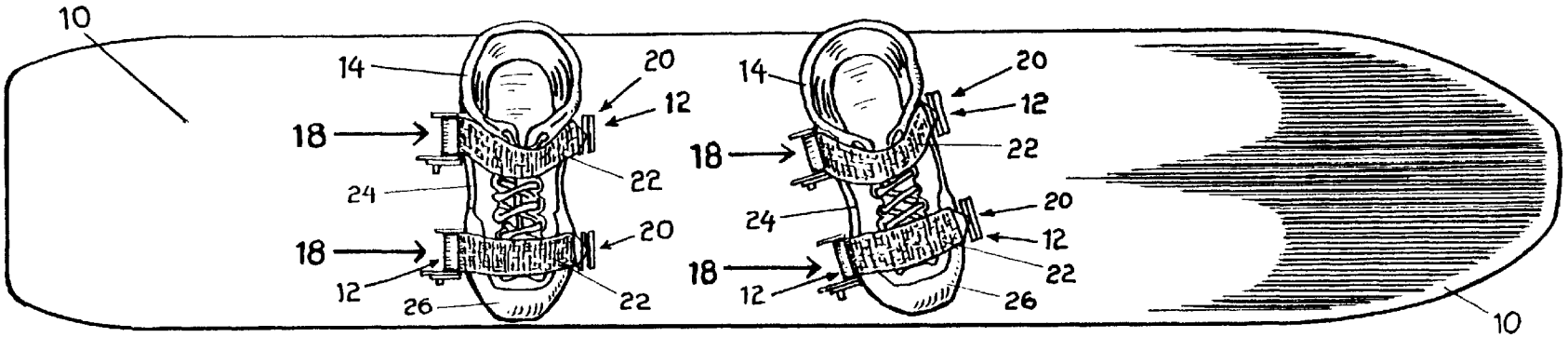
FIG. 1 is a top view of a snowboard with the subject bindings attached to a pair of snowboots received on top of the snowboard. Each binding includes a ratchet assembly and a quick release assembly with binding straps received around a portion of the instep and toe of the snowboots.

In FIG. 1, a top view of a snowboard 10 is shown with the subject snowboard bindings, having general reference numeral 12, attached to a pair of snowboots 14 received on a top 16 of the snowboard 10. Broadly, each binding 12 includes a ratchet assembly having general reference numeral 18, a quick release assembly having general reference number 20 and binding straps 22. The binding straps 22 are shown receive around a portion of an instep 24 and a toe 26 of the snowboots 14. The ratchet assembly 18 is used for tightening the binding strap 22 over the instep 24 and the top 26 of the snowboot 14. The quick release assembly 20 is used for securing one end of the binding strap 22 and releasing the strap 22 when a snowboarder wishes to release the snowboot 14 from the snowboard 10. Note in this drawing, a pair of bindings 12 are used for securing tightly each snowboot 14 to the top 16 of the snowboard 10. Also, in FIG. 1 a cuff or a highback for retaining the boot 14 in the binding 12 or slipping out of the back of the binding 12 is not show for clarity. While a snowboot 14 is mentioned herein, it should be kept in mind that various types of outdoor boots and downhill ski boots could be used with the subject bindings without departing from the spirit and scope of the invention.

Figure 2:
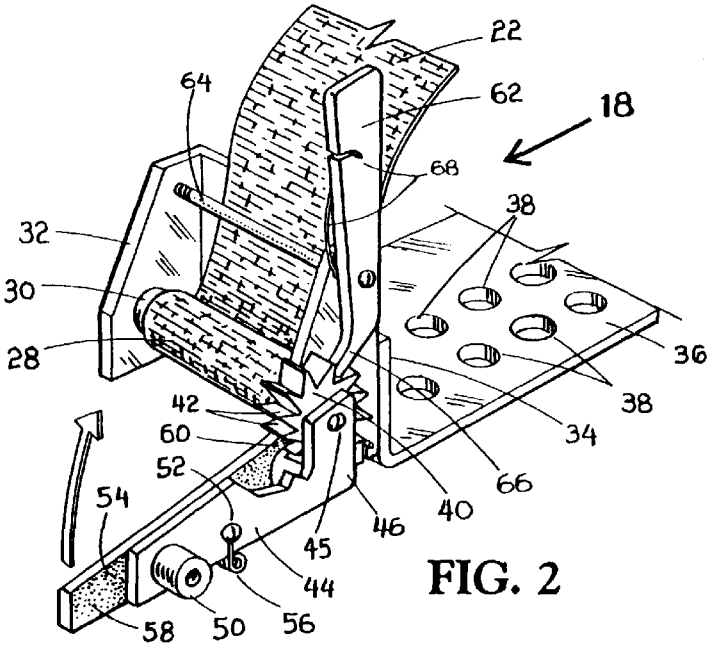
FIG. 2 is a perspective view of the ratchet assembly with one end of a binding strap attached to a spool mounted on a spool housing. The spool housing is shown attached to one side of a plate rail which is mounted on top of the snowboard.

In FIG. 2, a perspective view of the ratchet assembly 18 is shown with a first end 28 of the strap 22 secured to and wrapped around a spool 30. The spool 30 is rotatably mounted on a spool housing 32. The housing 32 is attached to a first vertical side 34 of a "U" shaped plate rail 36. The plate rail 36 includes a plurality of holes 38 therein which are used with fasteners for mounting the binding 12 on the snowboard 10. The fasteners are not shown in the drawing and only a portion of the plate rail 36 is shown. It should be mentioned that the plate rail 36 extends across the width of the sole of the snowboot 14 with the opposite side of the plate rail 36 used as part of the quick release assembly 18.

Mounted on one end of the spool 30 is a spool gear 40 having a plurality of gear teeth 42 therearound. A spool release lever 44 is attached at one end 46 to the spool gear 40 using a threaded screw 45. A portion of the spool release lever 44 has been cut away for viewing the spool gear 40. An opposite end 48 of the spool release lever 44 includes a small knob 50. The spool release lever 44 is pivotly attached using a threaded screw 52 to a spool advancing lever 54. The spool release lever 44 is spring biased on the spool advancing lever 54 using a coil spring 56. The spool advancing lever 54 includes a handle portion 58 and a pointed end 60 which is received between a pair of the gear teeth 42. The spool advancing lever 54 is used for rotating the gear 40 and in turn the spool 30 clockwise wrapping the strap 22 thereon.

A spool locking lever 62 is pivotly mounted on the spool housing 32 using an elongated threaded screw 64. The spool locking lever 62 includes a pointed end 66 which is also received between a pair of the gear teeth 42. The spool locking lever 62 includes a coil spring 68 with one end mounted thereon, wrapped around the threaded screw 64 with an opposite end mounted on the spool housing 32. The coil spring 68 is used for biasing the pointed end 66 clockwise for continuous engagement between the gear teeth 42. The spool locking lever 62 prevents movement of the spool 30 when the spool advancing lever 54 is released from the gear teeth 42 and the lever 54 is rotated counterclockwise prior to reengaging the gear 40. At this point, the spool advancing lever 54 is used to continue the clockwise rotation of the spool 30 for tightening the strap 22 on the snowboot 14.

Figure 3:
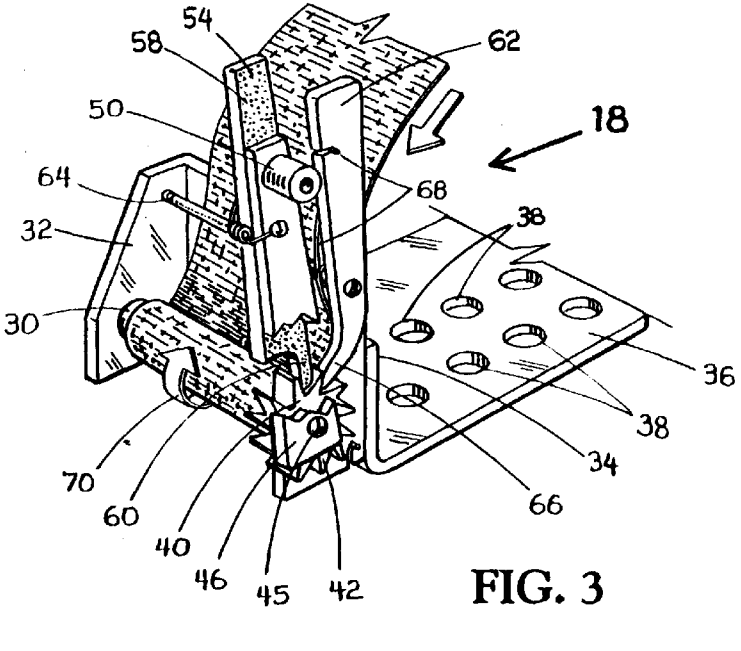
FIG. 3 iso perspective view of the ratchet assembly as shown in FIG. 2 wherein a spool advancing lever has been raised and rotated clockwise winding a portion of the binding strap on the spool.

In FIG. 3, perspective view of the ratchet assembly 18 is shown wherein the spool advancing lever 54 has been raised and rotated clockwise into a 12 o'clock position and winding an additional portion of the binding strap 22 on the spool 30 as indicated by arrow 70. As mentioned above, the spool advancing lever 54 can now be reversed and moved counterclockwise along with the spool release lever 44 and back to a 9 o'clock position as shown in FIG. 2. When this occurs, the pointed end 60 of the spool advancing lever 54 is released from between the gear teeth 42 and the pointed end 60 rides over the top of the gear teeth until it is reseated between a pair of the gear teeth 42. During this movement of the spool advancing lever 54, the pointed end 66 of the spool locking bar 62 maintains engagement of the gear teeth 42 and prevents movement of the spool 30 counterclockwise and prevents the unwrapping of the binding strap 22 thereon.

Figure 4:
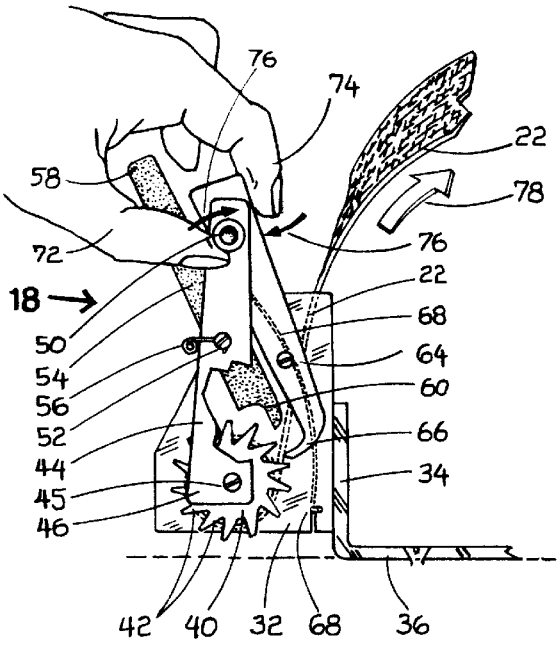
FIG. 4 is a side view of the ratchet assembly wherein the spool advancing lever and a spool locking lever are rotated counterclockwise and a spool release lever is rotated clockwise to release the binding strap wound around the spool.

In FIG. 4, a side view of the ratchet assembly 18 is shown. In this view, a thumb 72 of the snowboarder has gripped the knob 50 of the spool release lever 44 and moved it clockwise as indicated by arrow 73. At the same time, a finger 74 of the snowboarder has gripped the spool locking lever 62 and rotated it counterclockwise as indicated by arrow 76. The spool locking lever 62 moves against and the side of the spool advancing lever 54 and also rotates the spool advancing lever 54 counterclockwise. This counterclockwise movement of the spool locking lever 62 and spool advancing lever 54 is against the spring bias force of the coil spring 56 and the coil spring 68. At this time, both the pointed end 66 of the spool locking lever 62 and the pointed end 60 of the spool advancing lever 54 are released from the gear teeth 42 and the spool 30 is now free to rotate in a counterclockwise section for unwrapping the binding strap 22 thereon as indicated by arrow 78.

The unwrapping of the binding strap 22 on the spool 30 is necessary when the snowboot 14 is received on top of the plate rail 36 attached to the snowboard 10. At this time, sufficient slack in the binding strap 22 is required for receipt over the toe 26 or the instep 24 of the snowboot 14 and to attach the binding strap 22 to the quick release assembly 20. The binding strap 22 once attached to the quick release assembly 20 is then tightened using the ratchet assembly 18 as described in FIGS. 2–4.

Figure 5:
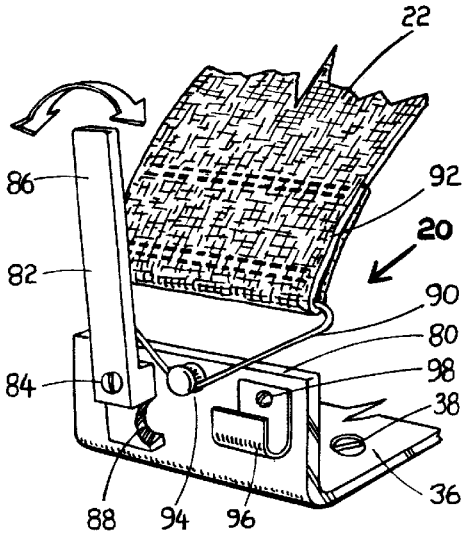
FIG. 5 is a perspective view of the quick release assembly attached to a portion of the plate rail and with a clip latch and release lever in a raised position and a clip mounted on one end of the binding strap received around a portion of a clip pin.

In FIG. 5, a perspective view of the quick release assembly 20 is shown. In this view, the quick release assembly 20 uses a portion of a second vertical side 80 of the "U" shaped plate rail 36. A clip latch and release lever 82 is pivotly mounted on the vertical side 80 using a threaded screw 84. The clip latch and release lever 82 includes a handle 86 at one end and a beveled notch 88 in an opposite end. The lever 82 is shown in a raised 12 o'clock position, so that a clip 90 mounted on a second end 92 of the binding strap 22 can be received around a portion of a clip pin 94 mounted on the vertical side 80.

Figure 6:
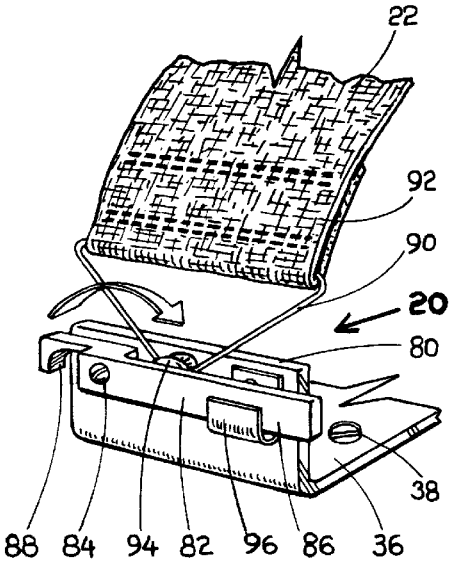
FIG. 6 is a perspective view of the quick release assembly with the clip latch and release lever in a lowered and locked position for preventing the clip from coming loose from the clip pin.

In FIG. 6, a perspective view of the quick release assembly 20 is shown with the clip latch and release lever 82 lowered in a 3 o'clock position and received in a retainer 96. The retainer 96 is attached to the vertical side 80 using a threaded screw 98. In this position, the clip latch and release lever 82 is in a locked position for preventing the clip 90 from coming loose from the clip pin 94 during the operation of the snowboard 10. On the inside of the handle 86 and not shown in the drawing is a slight bevel which is received of the head of the threaded screw 98 which holds the retainer 96 in place.

Figure 7:
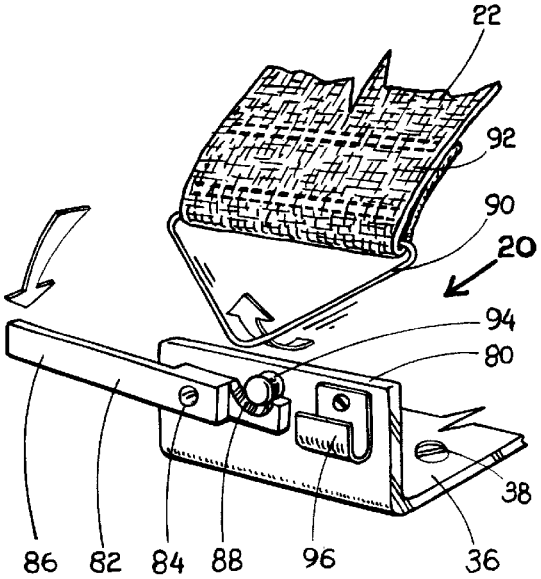
FIG. 7 is a perspective view of the quick release assembly with the clip latch and release lever rotated counterclockwise and a beveled notch in the end of the clip latch and release lever engaging and releasing the clip from the clip pin.

In FIG. 7, a perspective view of the quick release assembly 20 is shown with the clip latch and release lever 82 rotated counterclockwise into a 10 o'clock position. As the lever 82 is rotated in this manner, the beveled notch 88 moves upwardly and engages a portion of the clip 90 for releasing the clip 90 from the clip pin 94 as indicated by arrow 100. By using the beveled notch 88 of the clip latch and release lever 82, the snowboarder can quickly release the binding strap 22 from the quick release assembly 20 and in turn remove the snowboot 14 from the binding 12.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A binding used for securing a snowboarder's snowboot on top of a snowboard, the binding mounting on the snowboard and received around a portion of the instep or around a portion of the toe of each snowboot; the binding comprising:

a "U" shaped plate rail adapted for mounting on the snowboard and perpendicular to a length of the snowboot and adapted for receiving a portion of the bottom of the snowboot thereon, said plate rail having a first vertical side disposed on one side of the snowboot and a second vertical side disposed on an opposite side of the snowboot;

a flexible strap disposed perpendicular to the length of the snowboot, said strap having a first end and second end, a portion of said strap adapted for receipt over a top of a portion of the snow boot;

a rotatable spool mounted on a spool housing, said spool housing mounted on said first vertical side of said plate rail, the first end of said flexible strap attached to said spool and wrapped therearound;

a spool gear mounted on one side of said spool;

a spool advancing lever having one end releasably attached to said spool gear; said spool advancing lever for rotating said spool and tightening said flexible strap therearound;

a spool release lever attached to said spool gear for releasing said spool advancing lever from said spool gear;

a spool locking lever rotatably attached to said spool housing, said spool locking lever releasably attached to said spool gear; and a quick release assembly mounted on said second vertical side of said plate rail, the second end of said flexible strap releasably attached to said quick release assembly.

2. The binding as described in claim 1 wherein said quick release assembly includes a clip latch and release lever for holding the second end of said flexible strap on said quick release assembly and for releasing the second end of said flexible strap therefrom.

3. The binding as described in claim 1 wherein said quick release assembly includes a clip pin thereon for releasably engaging a clip mounted on the second end of said flexible strap.

4. The binding as described in claim 3 wherein said quick release assembly includes a clip latch and release lever, said clip latch and release lever having a handle at one end thereof and a beveled notch at an opposite end thereof, said handle used for holding said clip on said clip pin and said beveled notch used for releasing said clip from said clip pin.

5. The binding as described in claim 4 wherein said quick release assembly includes a handle retainer thereon, said retainer receiving a portion of said handle therein when said clip latch and release lever is in a closed and locked position holding said clip on said clip pin.

6. The binding as described in claim 1 wherein said spool advancing lever is disposed next to and rotatably attached to said spool release lever, said spool advancing lever spring biased on said spool release lever for biasing one end of said spool advancing lever in releasable attachment to said spool gear.

7. The binding as described in claim 1 wherein said spool locking lever is spring biased on said spool housing for biasing one end of said spool locking lever in releasable attachment to said spool gear.

8. A binding used for securing a snowboarder's snowboot on top of a snowboard, the binding mounting on the snowboard and received around a portion of the instep or around a portion of the toe of each snowboot, the binding operated by one hand of the snowboarder, the binding comprising:

a "U" shaped plate rail adapted for mounting on the snowboard and perpendicular to a length of the snowboot and adapted for receiving a portion of the bottom of the snowboot thereon, said plate rail having a first vertical side disposed on one side of the snowboot and a second vertical side disposed on an opposite side of the snowboot, said plate rail having a plurality of holes therein for receiving fasteners and adjustably mounting said plate rail on the snowboard;

a flexible strap disposed perpendicular to the length of the snowboot, said strap having a first end and second end, a portion of said strap adapted for receipt over a top of a portion of the snow boot;

a rotatable spool mounted on a spool housing, said spool housing mounted on said first vertical side of said plate rail, the first end of said flexible strap attached to said spool and wrapped therearound, the length of said spool disposed parallel to the length of the snowboot;

a spool gear mounted on one side of said spool;

a spool advancing lever having one end releasably attached to said spool gear; said spool advancing lever for rotating said spool and tightening said flexible strap therearound;

a spool release lever rotatably attached to said spool gear, said spool release lever rotatably attached to said spool advancing lever for releasing said spool advancing lever from said spool gear;

a spool locking lever rotatably attached to said spool housing, said spool locking lever releasably attached to said spool gear; and a quick release assembly mounted on the second vertical side of said plate rail, the second end of said flexible strap releasably attached to said quick release assembly.

9. The binding as described in claim 8 wherein said quick release assembly includes a clip latch and release lever for holding the second end of said flexible strap on said quick release assembly and for releasing the second end of said flexible strap therefrom.

10. The binding as described in claim 8 wherein said quick release assembly includes a clip pin thereon for releasably engaging a clip mounted on the second end of said flexible strap.

11. The binding as described in claim 10 wherein said quick release assembly includes a clip latch and release lever, said clip latch and release lever having a handle at one end thereof and a beveled notch at an opposite end thereof, said handle used for holding said clip on said clip pin and said beveled notch used for releasing said clip from said clip pin.

12. The binding as described in claim 11 wherein said quick release assembly includes a handle retainer thereon, said retainer receiving a portion of said handle therein when said clip latch and release lever is in a closed and locked position holding said clip on said clip pin.

13. The binding as described in claim 8 wherein said spool advancing lever is disposed next to and parallel to said spool release lever, said spool advancing lever spring biased on said spool release lever for biasing one end of said spool advancing lever in releasable attachment to said spool gear, whereby said spool advancing lever and said spool release lever adapted for being operated by one hand of the snowboarder.

14. The binding as described in claim 13 wherein said spool locking lever is spring biased on said spool housing for biasing one end of said spool locking lever in releasable attachment to said spool gear, whereby said spool advancing lever, said spool release lever and said spool locking lever are adapted for being operated by one hand of the snowboarder when tightening and loosening said flexible strap on the rotatable spool.

15. A binding used for securing a snowboarder's snowboot on top of a snowboard, the binding mounting on the snowboard and received around a portion of the instep or around a portion of the toe of each snowboot; the binding operated by one hand of the snowboarder, the binding comprising:

a "U" shaped plate rail adapted for mounting on the snowboard and perpendicular to a length of the snowboot and adapted for receiving a portion of the bottom of the snowboot thereon, said plate rail having a first vertical side disposed on one side of the snowboot and a second vertical side disposed on an opposite side of the snowboot, said plate rail having a plurality of holes therein for receiving fasteners and adjustably mounting said plate on the snowboard;

a flexible strap disposed perpendicular to the length of the snowboot, said strap having a first end and second end, the second end of said strap having a clip mounted thereon, a portion of said strap adapted for receipt over a top of a portion of the snow boot;

a rotatable spool mounted on a spool housing, said spool housing mounted on said first vertical side of said plate rail, the first end of said flexible strap attached to said spool and wrapped therearound, the length of said spool disposed parallel to the length of the snowboot;

a spool gear mounted on one side of said spool;

a spool advancing lever having one end releasably attached to said spool gear and spring biased thereon; said spool advancing lever for rotating said spool and tightening said flexible strap therearound;

a spool release lever rotatably attached to said spool gear, said spool release lever rotatably attached to said spool advancing lever for releasing said spool advancing lever from said spool gear;

a spool locking lever rotatably attached to said spool housing, said spool locking lever releasably attached to said spool gear and spring biased thereon; and a clip latch and release lever rotatably mounted on said second vertical side of said plate rail, said clip latch and release lever for releasing said clip on the second end of said flexible strap from a clip pin mounted on and extending outwardly from said second side of said plate rail.

16. The binding as described in claim 15 wherein said clip latch and release lever include a handle at one end thereof and a beveled notch at an opposite end thereof, said handle used for holding said clip on said clip pin and said beveled notch used for releasing said clip from said clip pin.

17. The binding as described in claim 16 further including a handle retainer mounted on said second vertical side of said plate rail, said handle retainer receiving a portion of said handle therein when said clip latch and release lever is in a closed and locked position holding said clip on said clip pin.

* * * * *